US008432092B2

(12) United States Patent
Mori

(10) Patent No.: US 8,432,092 B2
(45) Date of Patent: Apr. 30, 2013

(54) SPARK PLUG

(75) Inventor: Kiyoteru Mori, Nagoya (JP)

(73) Assignee: NGK Spark Plug Co., Ltd. (JP)

( * ) Notice: Subject to any disclaimer, the term of this patent is extended or adjusted under 35 U.S.C. 154(b) by 0 days.

(21) Appl. No.: 13/521,489

(22) PCT Filed: Aug. 23, 2010

(86) PCT No.: PCT/JP2010/005161

§ 371 (c)(1),
(2), (4) Date: Jul. 11, 2012

(87) PCT Pub. No.: WO2011/086614

PCT Pub. Date: Jul. 21, 2011

(65) Prior Publication Data

US 2013/0009535 A1 Jan. 10, 2013

(30) Foreign Application Priority Data

Jan. 12, 2010 (JP) ..... 2010-003543

(51) Int. Cl.
*H01T 13/20* (2006.01)

(52) U.S. Cl.
USPC ..... 313/141; 313/140

(58) Field of Classification Search ..... 313/118, 313/140–143; 445/7
See application file for complete search history.

(56) References Cited

U.S. PATENT DOCUMENTS

| | | | | |
|---|---|---|---|---|
| 5,239,225 | A | 8/1993 | Moriya et al. | 313/141 |
| 6,628,050 | B1 | 9/2003 | Kameda et al. | 313/143 |
| 7,816,846 | B2 | 10/2010 | Takada et al. | 313/143 |

FOREIGN PATENT DOCUMENTS

| | | |
|---|---|---|
| JP | 4138685 | 5/1992 |
| JP | 06-176848 | 6/1994 |
| JP | 2001-143847 | 5/2001 |
| JP | 2002-270332 | 9/2002 |
| JP | 2008-108481 | 5/2008 |

OTHER PUBLICATIONS

Form PCT/ISA/210—Int'l Search Report (from corresponding Int'l Patent App. No. PCT/JP2010/005161—English version only); 1 page.

*Primary Examiner* — Joseph L Williams
(74) *Attorney, Agent, or Firm* — Kusner & Jaffe

(57) ABSTRACT

A sparkplug includes an insulator having an axial hole, a center electrode of which a front end is placed further forwards than a front end of the insulator, and a shell. The center electrode has a shoulder portion and a main body portion and is made up of an outer layer and an inner layer. A front end face, which is connected to an outer circumferential surface of the insulator and the axial hole and slopes towards the rear end side, is formed at a front end portion of the insulator, and the front end of the insulator is placed further forwards than a boundary between the shoulder portion and the main body portion. A front end portion of the inner layer is placed further forwards than the boundary between the shoulder portion and the main body portion.

4 Claims, 14 Drawing Sheets

SPARK PLUG

TECHNICAL FIELD

The present invention relates to a spark plug which is used in an internal combustion engine or the like.

BACKGROUND ART

Spark plugs are mounted in a combustion system such as an internal combustion engine (an engine) for use in igniting the air-fuel mixture. In general, a spark plug includes an insulator having an axial hole, a central electrode which is inserted in the axial hole, a shell which is provided around an outer circumference of the insulator, and a ground electrode which is provided at a front end portion of the shell to form a spark discharge gap between the center electrode.

Incidentally, in the spark plug, the size of the spark discharge gap is enlarged as the electrodes wear while in use. When the size of the spark discharge gap is enlarged, a discharge voltage required to generate a spark in the spark discharge gap is increased. When the discharge voltage is increased in this way, there are fears that an electric current flows from the center electrode to the shell along the surface of the insulator (a so-called flashover occurs) or a spark (a so-called side spark as one form of flashover) is generated between a front end portion of the insulator and a front end portion of the shell, without generating a normal spark discharge in the spark discharge gap.

In order to prevent the flashover which is a discharge that occurs in any other positions than in the spark discharge gap (an abnormal discharge), it is considered to extend a distance of a path along the surface of the insulator (a creeping distance) among paths extending from the center electrode to reach the shell. As approaches for extending the creeping distance, there are proposed techniques in which a longer leg portion is formed, the outside diameter of the front end portion of the insulator is made relatively large, annular grooves are formed on the surface of the leg portion (for example, refer to Patent Literature 1), and a step is formed on an outer circumferential surface of the leg portion (for example, refer to Patent Literature 2).

RELATED ART LITERATURES

Patent Literatures

Patent Literature 1: JP-A-H06-176848
Patent Literature 2: JP-A-2001-143847

SUMMARY OF THE INVENTION

Problems to be Solved by the Invention

However, according to the approaches described above, although the occurrence of an abnormal discharge can be suppressed, all of the approaches involve fears that the front end of the insulator is overheated (that is, the thermal resistance becomes insufficient). Because of this, there are fears that a so-called pre-ignition, in which the air-fuel mixture is thermally ignited before the ignition of the spark plug, is generated due to the overheated front end portion becomes a firing source.

The invention has been made in view of these situations, and an object thereof is to provide a spark plug which can realize the suppression of abnormal discharge by improving the flashover resistance properties and which can increase the thermal resistance thereof.

Means for Solving the Problems

Hereinafter, configurations which are suitable for solving the problem will be itemized. Additionally, a function and advantage which are specific to each configuration will also be described as required.

Configuration 1

A spark plug according to the present configuration includes: an insulator having an axial hole which extends along an axis; a center electrode which is inserted into a front end portion of the axial hole and which has a front end placed further forwards than a front end of the insulator; and a cylindrical shell which is provided around an outer circumference of the insulator; the center electrode including a shoulder portion which increases in diameter as it extends from a rear end of a front end portion of the center electrode towards a rear end side and a main body portion which extends from a rear end of the shoulder portion towards the rear end side along the axis, the center electrode having a multi-layer construction configured of an outer layer and an inner layer which is provided in an interior of the outer layer and which contains a material having better thermal conductivity than that of the outer layer, characterized in that: a front end face, which is connected to an outer circumferential surface of the insulator and the axial hole and slopes towards the rear end side, is formed at a front end portion of the insulator, the front end of the insulator is placed further forwards than a boundary between the shoulder portion and the main body portion of the center electrode, a front end portion of the inner layer is placed further forwards along the axis than the boundary between the shoulder portion and the main body portion of the center electrode, and regarding a cross-section which includes the axis, when a straight line which is obtained by extending an outline of the axial hole towards the front end side is referred to as a straight line L1, a straight line which is obtained by extending an outline of an outer surface of the front end portion of the insulator towards the front end side is referred to as a straight line L2, a straight line which is obtained by extending an outline of the front end face of the insulator is referred to as a straight line L3, a bisector of an angle formed by an outline of the shoulder portion and an outline of the main body portion is referred to as a straight line L4, and a straight line which intersects the axis at right angles is referred to as a straight line L5, angles A1, A2, A3, A4 and A5 which are described below satisfy the following expressions (1), (2), (3) and (4).

$$A1>90° \quad (1);$$

$$A2<90° \quad (2);$$

$$A4>A5 \quad (3);$$

$$A3>A1 \quad (4),$$

where, the angle A1: an angle placed on a side where the insulator exists in angles which are formed by the straight line L1 and the straight line L3; the angle A2: an angle placed on a side where the insulator exists in angles which are formed by the straight line L2 and the straight line L3; the angle A3: an angle which is formed by the outline of the shoulder portion and the outline of the main body portion; the angle A4: an acute angle in angles which are formed by the straight line L3 and the straight line L5; the angle A5: an acute angle in angles which are formed by the straight line L4 and the straight line L5.

In order to suppress the occurrence of a discharge at the boundary portion between the shoulder portion and the main body portion, it is preferable that A3 is relatively large. Accordingly, it is preferable that A3≧130°, and it is more preferable that A3≧140°.

Configuration 2

In a spark plug according to the present configuration, the spark plug according to the configuration 1 is characterized in that, regarding the cross-section which includes the axis, when a boundary point between the shoulder portion and the main body portion is referred to as X1 and a point of intersection between the straight line L1 and the straight line L3 is referred to as X2, a shortest distance between the boundary point X1 and the boundary point X2 is 0.2 mm or longer.

Configuration 3

In a spark plug according to the present configuration, the spark plug according to the configuration 1 or 2 is characterized in that, regarding a cross-section which includes the axis and a center of the distal end face of the ground electrode, the straight line L3 intersects a portion of an outline of the distal end face of the ground electrode which is placed further forwards in the direction of the axis than the center of the distal end face.

Configuration 4

In a spark plug according to the present configuration, the spark plug according to any of the configurations 1 to 3 is characterized in that, regarding the cross-section which includes the axis, the straight line L4 intersects the outline of the front end face of the insulator.

Advantage of the Invention

According to the spark plug of configuration 1, the insulator satisfies A1>90° and A2<90°, and the front end face of the insulator is formed so as to slope towards the rear end side in the direction of the axis from the outer surface of the front end portion of the insulator towards the axial hole. Consequently, the creeping distance of the insulator can be made relatively long.

Further, when a spark discharge is generated at the boundary portion between the shoulder portion and the main body portion, the discharge tends to be generated easily towards the direction of the straight line L4 along which the field strength becomes the highest. However, according to the spark plug of configuration 1, the front end of the insulator is placed further forwards in the direction of the axis than the boundary portion and is formed so that A4>A5 is satisfied. In addition, the front end face of the insulator is formed to slope further rearwards than the direction in which the spark discharge tends to be generated most easily at the boundary portion. Because of these facts, the spark to the shell can be disturbed by the front end face of the insulator more reliably, thereby making it possible to prevent the occurrence of a direct discharge between the boundary portion and the shell more reliably. As a result, in combination with the configuration in which the creeping distance can be made relatively long, the flashover resistance is increased, thereby making it possible to prevent the occurrence of an abnormal discharge effectively.

As has been described above, the creeping distance can be extended by forming the front end face of the insulator so as to slope towards the rear end side in the direction of the axis. However, when A1 is made excessively large (in other words, when A2 is made excessively small), the volume of the front end portion of the insulator is reduced, and the front end face is shaped so that in particular, the outer portion of the front end portion of the insulator projects excessively towards the front end side in the direction of the axis. Because of this, the front end portion of the insulator tends to be overheated easily, resulting in fears that the thermal resistance is reduced or the front end portion of the insulator breaks through chipping, for example.

In this regard, according to the spark plug of the configuration 1, the front end face of the insulator is configured so as to satisfy A3>A1, and therefore, it can be prevented that A1 becomes too large. As a result, the outer portion of the front end of the insulator can be restricted from projecting excessively towards the front end side in the direction of the axis, whereby the thermal resistance can be improved and the breakage of the insulator can be prevented.

It can also considered that by simply reducing the value of A1 irrespective of the value of A3, the projection of the outer portion of the front end portion of the insulator can be suppressed. However, in this case, in case the front end face of the insulator is formed so as not to satisfy A3>A1, the angle A3 becomes very small, and therefore, a discharge tends to be generated easily at the boundary portion between the shoulder portion and the main body portion when a voltage is applied. Namely, in case the front end face of the insulator is formed so as not to satisfy A3>A1, there are fears that a sufficient performance cannot be ensured with respect to at least either of thermal resistance and flashover resistance. In other words, by satisfying A3>A1, a sufficient performance can be ensured with respect to both thermal resistance and flashover resistance.

In addition, according to the spark plug of the configuration 1, the front end portion of the inner layer which has the superior thermal conductivity is placed further forwards in the direction of the axis than the boundary between the shoulder portion and the main body portion. Because of this, even in the insulator of the present configuration which is configured so that the outer portion of the front end thereof projects slightly towards the front end side in the direction of the axis, heat at the front end portion can be conducted effectively. Accordingly, the thermal resistance can be further increased.

According to the spark plug of the configuration 2, the sufficient clearance of 0.2 mm or larger is formed between the boundary portion between the shoulder portion and the main body portion and the insulator. Therefore, a voltage required to generate a dielectric breakdown between the boundary portion and the insulator can be increased to a high level. Consequently, the discharge between the boundary portion and the insulator can be prevented more reliably, and hence, the abnormal discharge can be prevented more reliably.

According to the spark plug of configuration 3, the spark plug includes the ground electrode of which the distal end face faces the side surface of the center electrode, and in the cross-section which contains the axis and the center of the distal end face of the ground electrode, the straight line L3 passes through the portion of the distal end face of the ground electrode which is placed further forwards in the direction of the axis than the center thereof. Here, when a discharge is generated between the center electrode and the ground electrode with the spark creeps along the front end surface of the insulator, the discharge is generated easily between the corner portion of the distal end portion of the ground electrode where the field strength is relatively high and the center electrode. However, according to the configuration 3, the discharge tends to be generated easily between a corner portion of the distal end of the ground electrode, which is placed further forwards than the other in the direction of the axis, and the center electrode. Namely, a spark tends to be generated easily in the position which lies close to the center of a combustion chamber, and the disturbance of flame growth by the ground electrode is made difficult to occur. Because of this, the ignitability can be improved.

On the other hand, in the above-described cross-section, the straight line L3 is made to intersect the distal end face of the ground electrode. Namely, the distal end face of the ground electrode is disposed so as to project forwards in the direction of the axis to some extent. By so doing, the improving effect of the ignitability is exhibited more reliably.

According to the spark plug of the configuration 4, the front end face of the insulator is placed on the straight line L4 which extends in the direction along which a spark discharge is generated most easily at the boundary portion between the shoulder portion and the main body portion. Consequently, the spark from the center electrode to the shell can be disturbed by the front end face of the insulator more reliably, thereby making it possible to prevent a direct spark between the boundary portion and the shell more effectively. As a result, the occurrence of an abnormal discharge can be prevented more reliably, thereby making it possible to realize a more superior flashover resistance.

MODE FOR CARRYING OUT THE INVENTION

Figure 1:
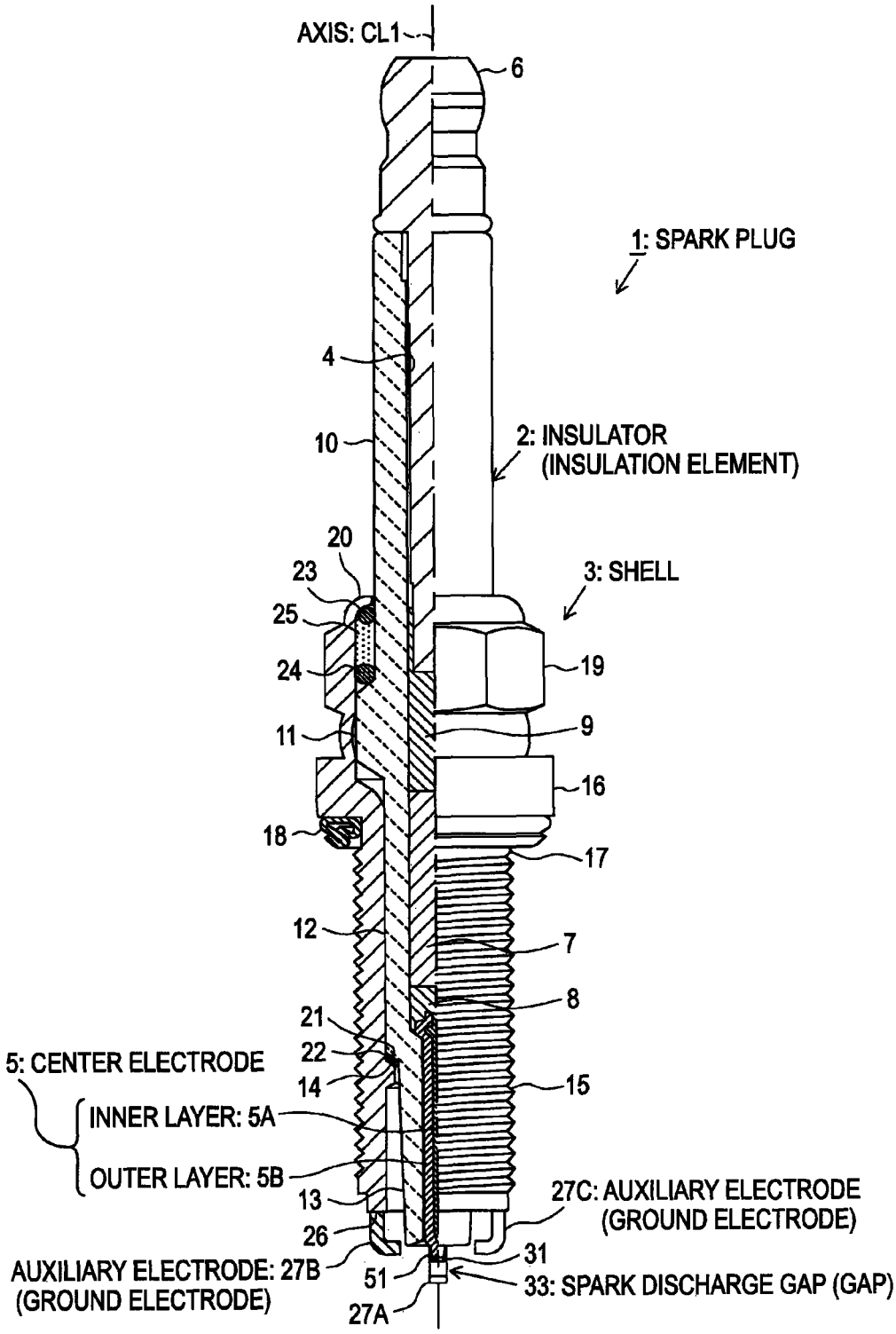
FIG. 1 is a partially cutaway front view showing the configuration of a spark plug.

Hereinafter, one embodiment will be described by reference to the drawings. FIG. 1 is a partially cutaway front view showing a spark plug 1. It should be noted that in FIG. 1, the description will be made by referring to the direction of an axis CL1 of the spark plug 1 as a vertical direction in the figure and by referring to a lower side and an upper side of the figure as a front end side and a rear end side of the spark plug 1, respectively.

The spark plug 1 includes a cylindrical insulator 2 which is an insulation element and a cylindrical shell 3 which holds the insulator 2.

As is known, the insulator 2 is formed by sintering alumina or the like. When looking at an external appearance thereof, the insulator 2 includes a rear end side body portion 10 which is formed at a rear end side thereof, a large-diameter portion 11 which is formed forwards of the rear end side body portion 10 so as to project radially outwards, an intermediate body portion 12 which is formed forwards of the large-diameter portion 11 so as to be smaller in diameter than the large-diameter portion 11, and a leg portion 13 which is formed forwards of the intermediate body portion 12 so as to be smaller in diameter than the intermediate portion 12. Additionally, the large-diameter portion 11, the intermediate body portion 12 and most of the leg portion 13 of the insulator 2 are accommodated in the interior of the shell 3. In addition, a tapered step portion 14 is formed at a connecting portion where the intermediate portion 12 and the leg portion 13 are connected, and the insulator 2 is locked on the shell 3 at this step portion 14.

Further, an axial hole 4 is formed along the axis CL1 in the insulator 2, and a center electrode 5 is inserted and fixed in a front end portion of the axial hole 4. The center electrode 5 has a rod shape (a cylindrical shape) as a whole and projects from a front end of the insulator 2. Additionally, the center electrode 5 includes an outer layer 5B which is made of an Ni alloy which contains mainly nickel (Ni) and an inner layer 5A which is made of copper, a copper alloy or pure Ni which has a higher thermal conductivity than that of the Ni alloy. Further, a cylindrical noble metal tip 31 made of a noble metal alloy (for example, an iridium alloy) is joined to a front end portion 51 of the center electrode 5.

In addition, a terminal electrode 6 is inserted and fixed in a rear end portion of the axial hole 4 in such a state that the terminal electrode 6 projects from a rear end of the insulator 2.

Further, a cylindrical resistor element 7 is provided between the center electrode and the terminal electrode 6 in the axial hole 4. Both end portions of the resistor element 7 are electrically connected to the center electrode 5 and the terminal electrode 6 via conductive glass seal layers 8, 9, respectively.

In addition, the shell 3 is made of metal such as low carbon steel and has a cylindrical shape, and a thread portion (an external thread portion) 15 is formed on an outer circumferential surface of the shell 3 for mounting the spark plug 1 in a combustion system such as an internal combustion chamber or a fuel cell reformer. Additionally, a seat portion 16 is formed on an outer circumferential surface of a portion of the shell 3 placed at the rear end side of the thread portion 15, and a ring-shaped gasket 18 is fitted on a thread neck 17 at a rear end of the thread portion 15. Further, a tool engagement portion 19 having a hexagonal shape in section is provided at a rear end portion of the shell 3 for engagement with a tool such as a wrench in mounting the spark plug 1 in the combustion system. Additionally, a crimp portion 20 is provided at a rear end of the shell 3 for holding the insulator 2. In this embodiment, the diameter of the shell 3 is reduced so as to make the spark plug 1 smaller in size. Because of this, the thread diameter of the thread portion 15 is M12 or smaller (for example, M10 or smaller).

In addition, a tapered step portion 21 is provided on an inner circumferential surface of the shell 3 for locking the insulator 2 thereon. Then, the insulator 2 is inserted from the rear end towards a front end of the shell 3 and is fixed therein by crimping an opening portion at the rear end of the shell 3 radially inwards, that is, by forming the crimp portion 20 in such a state that the step portion 14 of the insulator 2 is locked on the step portion 21 of the shell 3. An annular plate packing 22 is interposed between the step portions 14, 21 of the insulator 2 and the shell 3. By so doing, the gas tightness in the combustion chamber is maintained so that air-fuel mixture gas which enters a space between the leg portion 13 of the insulator 2 which is exposed to the interior of the combustion chamber and the inner circumferential surface of the shell 3 is not allowed to leak to the outside of the space.

Further, in order to ensure the perfect closure by crimping, annular ring members 23, 24 are interposed between the shell 3 and the insulator 2 at the rear end portion of the shell 3, and powder of talc 25 is filled between the ring members 23, 24. Namely, the shell 3 holds the insulator 2 via the plate packing 22, the ring members 23, 24 and the talc 25.

In addition, a parallel electrode 27A which is bent at an intermediate portion and auxiliary electrodes (corresponding to a ground electrode of the invention) 27B, 27C are joined to a front end portion 26 of the shell 3. The parallel electrode 27A and the auxiliary electrodes 27B, 27C are formed of Ni alloy.

The parallel electrode 27A is disposed so that a side surface of a distal end portion faces a front end face of the noble metal tip 31. Then, an aerial discharge is generated in a direction which substantially follows the direction of the axis CL1 in a gap defined between the parallel electrode 27A and the noble metal tip 31.

In addition, the auxiliary electrodes 27B, 27C are disposed so that respective distal end faces of both the auxiliary electrodes 27B, 27C face each other across the axis CL1, and the distal end faces of the auxiliary electrodes 27B, 27C face corresponding side surfaces of the center electrode 5. By adopting this configuration, a spark discharge is generated between the side surfaces of the center electrode 5 and the auxiliary electrodes 27B, 27C so that the spark creeps along the surface of the insulator 2.

Namely, the spark plug 1 of this embodiment is a so-called hybrid spark plug which functions as both a so-called parallel electrode plug in which a spark discharge is generated between the center electrode 5 and the parallel electrode 27A and a so-called semi-surface discharge plug in which a spark discharge is generated between the center electrode 5 and the auxiliary electrodes 27B, 27C.

Figure 2:
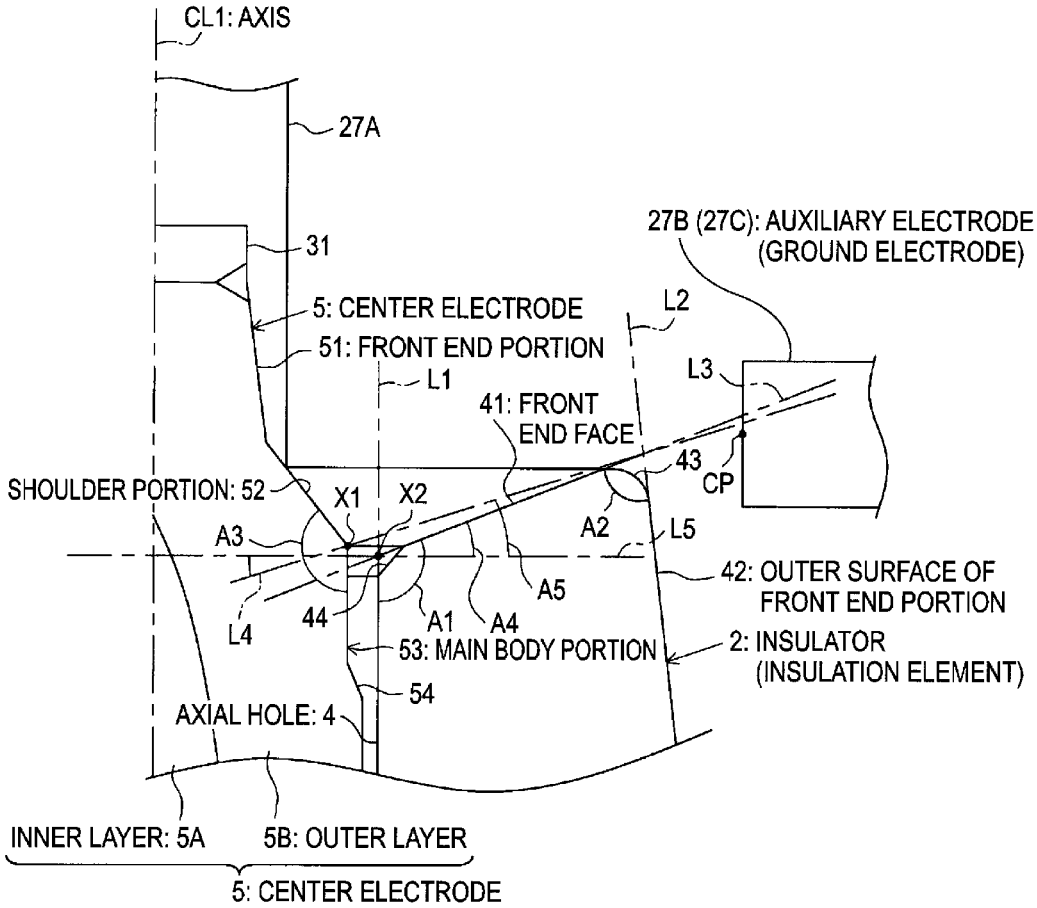
FIG. 2 is a partially enlarged sectional exemplary view showing the configurations of a front end portion of an insulator and a front end portion of a center electrode.

FIG. 2 is an enlarged sectional exemplary view illustrating the configuration of the insulator 2 of the embodiment. However, hatching that is generally given in a sectional view is omitted in FIG. 2 as a matter of convenience (in the same apply to FIGS. 3 to 6, 9, 10, and 12).

In this embodiment, as shown in FIG. 2, the center electrode 5 has a shoulder portion 52 which increases in diameter as it extends from the distal end portion 51 to which the noble metal tip 31 is joined towards a rear end side and a main body portion 53 which extends from the shoulder portion 52 towards the rear end along the axis CL1. In addition, a tapered portion 54 is provided at a rear end portion of the main body portion 53 so as to increase in diameter as the tapered portion 54 extends towards the rear end side.

Additionally, an front end face 41 of the insulator 2 is tapered so that when viewed in a cross-section which contains the axis CL1, the end face 41 slopes towards the rear end side in the direction of the axis CL1 from an outer surface 42 of a front end portion of the insulator 2 towards the axial hole 4. Further, the front end face 41 and the outer surface 42 of the front end portion of the insulator 2 are connected via a curved surface portion 43, and a chamfered portion 44 is formed between the end face 41 and the axial hole 4.

In addition, a front end of the insulator 2 is placed further forwards along the axis CL1 than a boundary between the shoulder portion 52 and the main body portion 53 of the center electrode 5 but is placed further rearwards along the axis CL1 than a boundary between the front end portion 51 and the shoulder portion 52 of the center electrode 5. Further, a front end portion of the inner layer 5A of the center electrode 5 is placed further forwards along the axis CL1 than the boundary between the shoulder portion 52 and the main body portion 53.

In addition, as has been described above, the front end face 41 of the insulator 2 is tapered so that the end face 41 slopes towards the rear end from the outer surface 42 of the front end portion towards the axial hole 4, and therefore, regarding the cross-section which contains the axis CL1, when, an angle placed on a side where the insulator 2 exists in angles which are formed by a straight line L1 and a straight line L3 is referred to as A1 (°), an angle placed on a side where the insulator 2 exists in angles which are formed by a straight line L2 and the straight line L3, is referred to as A2 (°), A1>90° and A2<90° are satisfied.

In addition, regarding the cross-section which contains the axis CL1, when an angle placed on a center electrode 5 side in angles which are formed by an outline of the shoulder portion 52 and an outline of the main body portion 53 is referred to as A3 (°), an acute angle in angles which are formed by the straight line L3 and a straight line L5 is referred to as A4 (°), and an acute angle in angles which are formed by a straight line L4 and the straight line L5 is referred to as A5 (°), the shapes of the insulator 2 and the center electrode 5 are set so that A4>A5 and A3>A1 are satisfied.

The "straight line L1" means a straight line which is obtained by extending an outline of the axial hole 4 towards the front end side in the cross-section which contains the axis CL1. The "straight line L2" means a straight line which is obtained by extending an outline of the outer surface 42 of the front end portion of the insulator 2 towards the front end side in the cross-section which contains the axis CL1. The "straight line L3" means a straight line is obtained by extending an outline of the front end face 41 of the insulator 2 in the cross-section which contains the axis CL1. The "straight line L4" means a bisector of the angle A3 which is formed by the outline of the shoulder portion 52 and the outline of the main body portion 53 in the cross-section which contains the axis CL1. Further, the "straight line L5" means a straight line which intersects the axis CL1 at right angles.

The straight lines L1, L2, L3 are defined based on the outlines of the axial hole 4, the front end face 41 and the outer surface 42 of the front end portion which are formed substantially into a straight line without taking into consideration the curved surface portion 43 and the chamfered portion 44 which are formed continuously with the front end face 41.

In addition, in this embodiment, by forming the tapered portion 54 on the center electrode 5, a gap of a certain size is formed between the main body portion 53 and the axial hole 4. To describe this in detail, when a boundary point between the shoulder portion 52 and the main body portion 53 is referred to as X1, and a point of intersection between the straight line L1 and the straight line L3 is referred to as X2 in the cross-section which contains the axis CL1, a shortest distance between the boundary point X1 and the boundary point X2 is 0.2 mm or larger (more preferably 0.25 mm or larger).

Further, in a cross-section which contains the axis CL and a center CP of the distal end face of the auxiliary electrode 27B (27C), the distal end positions of the auxiliary electrodes 27B, 27C are set so that the straight line L3 intersects a portion of an outline of the distal end face of the auxiliary electrode 27B (27C) which is placed further forwards in the direction of the axis CL1 than the center CP of the distal end face of the auxiliary electrode 27B.

In addition, in order to prevent the frequent occurrence of discharge at the boundary portion between the shoulder portion 52 and the main body portion 53, the angle A3 is made as large as possible (for example, 135° or larger, and more preferably 140° or larger).

Thus, as has been described heretofore, according to the embodiment, the insulator 2 satisfies A1>90° and A2<90°, and the front end face 41 of the insulator 2 is formed so as to slope towards the rear end side in the direction of the axis CL1 from the outer surface 42 of the front end portion towards the axial hole 4. Consequently, the creeping distance of the insulator 2 can be made relatively long.

Further, when a spark discharge is generated at the boundary portion between the shoulder portion 52 and the main body portion 53, the discharge tends to be generated easily in the direction of the straight line L4 along which the field strength becomes the largest. However, according to the embodiment, the front end of the insulator 2 is placed further forwards in the direction of the axis CL1 than the boundary portion and is formed so that A4>A5 is satisfied, that is, the front end face 41 of the insulator 2 is formed so as to slope further rearwards than the direction in which the spark discharge is generated most easily at the boundary portion. Because of this, the spark to the shell 3 side can be disturbed more reliably by the front end face 41 of the insulator 2, thereby making it possible to prevent the occurrence of a direct discharge between the boundary portion and the shell 3 more reliably. As a result, in combination with the configuration in which the creeping distance can be made relatively long, the flashover resistance is increased, thereby making it possible to prevent the occurrence of abnormal discharge effectively.

Further, the front end face 41 of the insulator 2 is configured so as to satisfy A3>A1, and therefore, A1 can be prevented from becoming too large. By this configuration, an outer portion of the front end of the insulator 2 can be restricted from projecting excessively towards a front end side in the direction of the axis CL1, whereby the thermal resistance can be increased and the breakage of the insulator 2 can be prevented.

In addition, according to the embodiment, the front end portion of the inner layer 5A which has the superior thermal conductivity is placed further forwards in the direction of the axis CL1 than the boundary between the shoulder portion 52 and the main body portion 53. Because of this, even in the insulator 2 which is configured so that the outer portion of the front end thereof projects slightly towards the front end side in the direction of the axis CL1, heat at the front end portion can be conducted effectively. This can further increase the thermal resistance.

Additionally, the sufficient clearance of 0.2 mm or larger is formed between the boundary portion between the shoulder portion 52 and the main body portion 53 and the insulator 2. Therefore, a voltage required to generate a dielectric breakdown between the boundary portion and the insulator 2 can be increased to a high level. Consequently, the discharge between the boundary portion and the insulator 2 can be prevented reliably, and hence, the abnormal discharge can be prevented more reliably.

Further, in this embodiment, regarding the cross-section which contains the axis CL1 and the center CP of the distal end face of the ground electrode 27, the straight line L3 intersects the part of the outline of the distal end face of the ground electrode 27 which is placed further forwards in the direction of the axis CL1 than the center CP. Consequently, when a discharge is generated between the center electrode 5 and the ground electrode 27, the discharge is generated easily between the center electrode 5 and a corner portion of the distal end of the ground electrode 27, which is placed further forwards than the other in the direction of the axis CL1. Namely, a spark tends to be generated easily in the position which lies close to the center of the combustion chamber, and the disturbance of flame growth by the ground electrode 27 is made difficult to occur. Because of this, the ignitability can be increased.

As in this embodiment, in the shell 3 having the thread portion 15 of which the thread diameter is reduced to M12 or smaller, the distance between the insulator 2 and the shell 3 becomes relatively short, causing a concern that an abnormal discharge is generated. However, by satisfying the configuration described above, the occurrence of abnormal discharge can be prevented reliably. In other words, the configuration described above becomes effective in the spark plug which includes the shell 3 having the thread portion 15 of which the thread diameter is reduced to M12 or smaller.

Next, in order to verify the function and advantage which are provided by the embodiment, a flashover resistance evaluation test was carried out on samples 1, 2 which correspond to example according to the embodiment and samples 3 to 6 which correspond to comparison examples. The summary of the flashover resistance evaluation test carried out is as follows. Namely, plural spark plugs which were different variously in gap between a center electrode and an auxiliary electrode (a ground electrode) were prepared for each sample. The samples were mounted in a three-cylinder engine having a displacement of 0.66 L, and then, the engine was operated at full throttle (=3500 rpm). Then, an increase in the gap when an abnormal discharge was generated between the center electrode and the shell was identified for each sample (an abnormal discharge starting gap increase). It should be noted that the abnormal discharge is made more difficult to occur as the abnormal discharge starting gap increase becomes larger, and the flashover resistance is improved further.

Figure 3A:
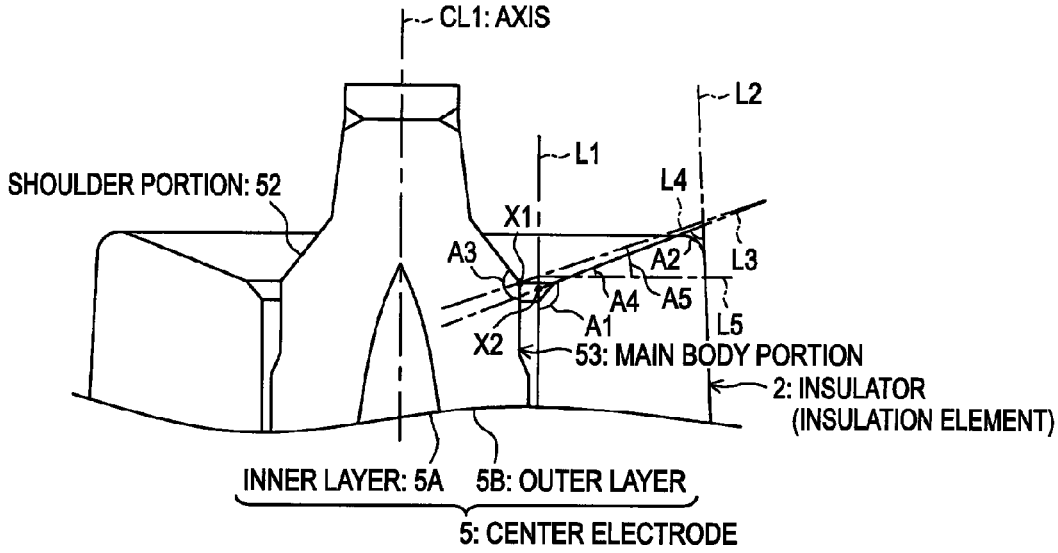
FIG. 3(*a*) is a partially enlarged sectional exemplary view showing a schematic configuration of a sample 1 and FIG. 3(*b*) is a partially enlarged sectional exemplary view showing a schematic configuration of a sample 2.
Figure 3B:
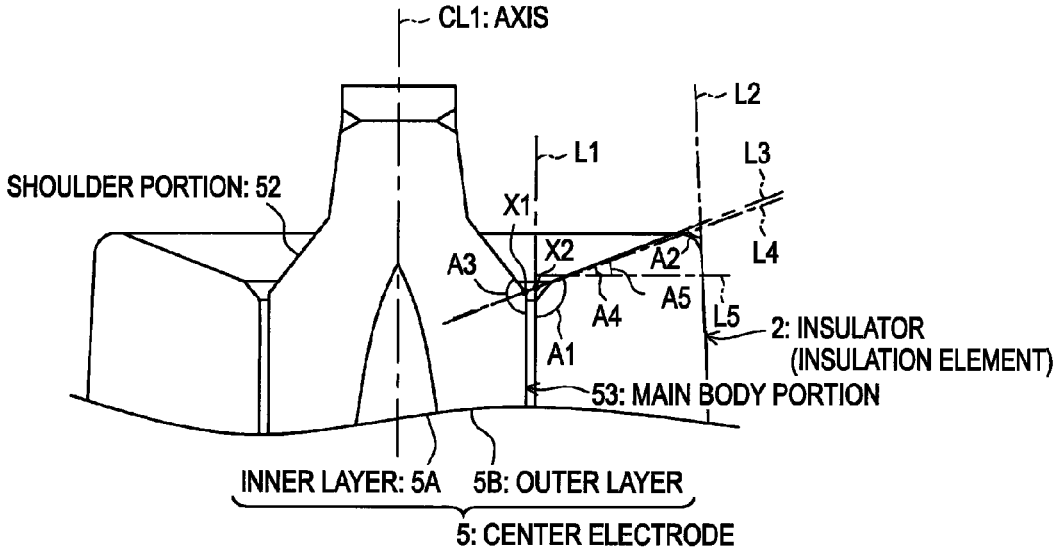

In addition, the samples 1 to 6 were configured as follows. Namely, as to the sample 1, as shown in FIG. 3(*a*), the angle A1 was set to 115°, the angle A2 to 65°, the angle A3 to 139.5°, the angle A4 to 25° and the angle A5 to 20.25°, a front end portion of an inner layer of a center electrode was placed further forwards in the direction of an axis than a boundary between a shoulder portion and a main body portion, and the shortest distance between the boundary points X1 and X2 was 0.25 mm. In addition, as to the sample 2, as shown in FIG. 3(*b*), values of the angles A1 to A5 and the position where a front end portion of an inner layer was disposed were the same as those of the sample 1, while the shortest distance between the boundary points X1 and X2 was 0.19 mm. Namely, both the samples were configured so that A1>90°, A2<90°, A4>A5 and A3>A1 were satisfied and that the front end portion of the inner layer was placed further forwards in the direction of the axis than the boundary between the shoulder portion and the main body portion.

Figure 4A:
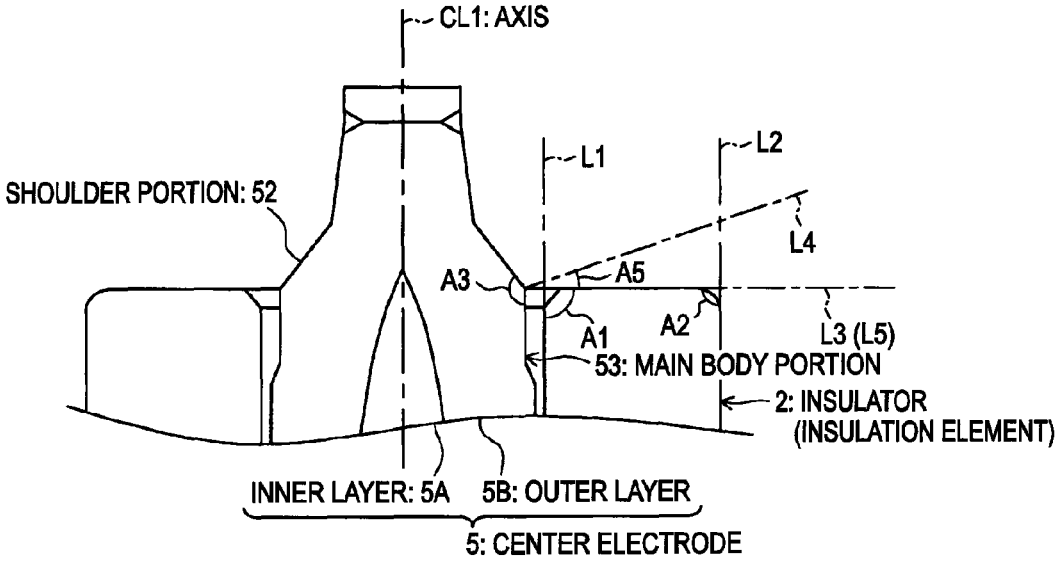
FIG. 4(*a*) is a partially enlarged sectional exemplary view showing a schematic configuration of a sample 3 and FIG. 4(*b*) is a partially enlarged sectional exemplary view showing a schematic configuration of a sample 4.
Figure 4B:
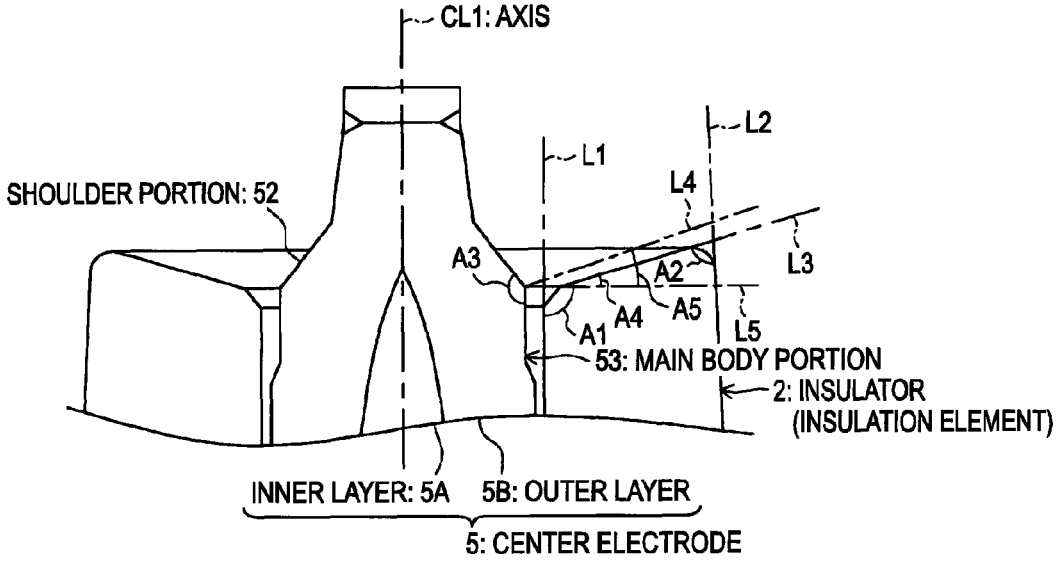
Figure 5A:
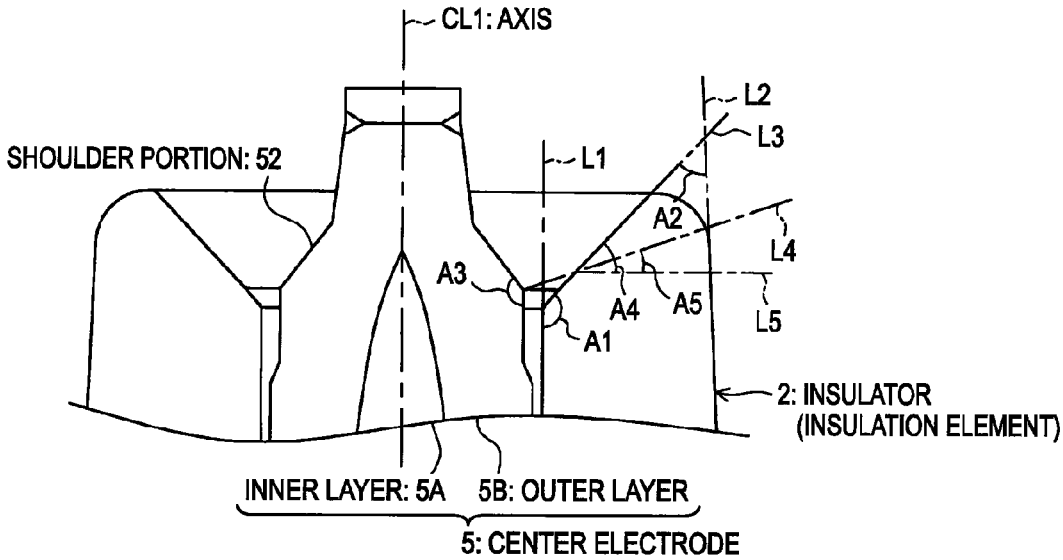
FIG. 5(*a*) is a partially enlarged sectional exemplary view showing a schematic configuration of a sample 5 and FIG. 5(*b*) is a partially enlarged sectional exemplary view showing a schematic configuration of a sample 6.
Figure 5B:
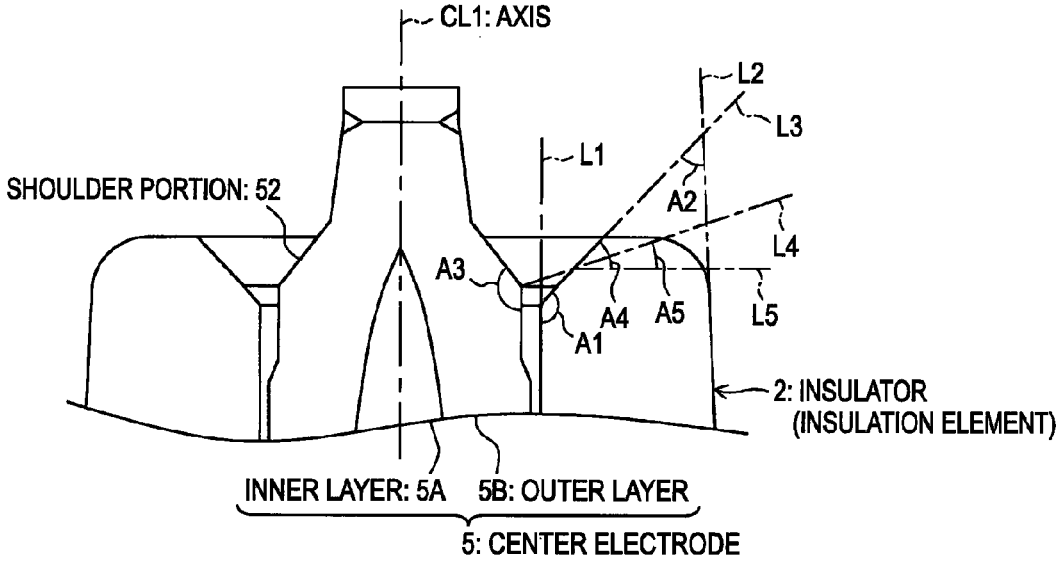

On the other hand, as to the sample 3, as shown in FIG. 4(*a*), the angle A1 was set to 90°, A2 to 90°, A3 to 139.5°, A4 to 0° and A5 to 20.25°, and A1>90° and A2<90° were not satisfied. In addition, as to the sample 4, as shown in FIG. 4(*b*), the angle A1 was set to 110°, A2 to 70°, A3 to 139.5°, A4 to 20° and A5 to 20.25°, and A4>A5 was not satisfied. Additionally, as to the sample 5, as shown in FIG. 5(*a*), the angle A1 was set to 139.5°, A2 to 40.5°, A3 to 139.5°, A4 to 49.5° and A5 to 20.25°, and A3>A1 was not satisfied. In addition, as to the sample 6, as shown in FIG. 5(*b*), values of the angles A1 to A5 were the same as those of the sample 5, while the radius of curvature of a curved surface portion which connects a front end face and an outer surface of a front end portion of an insulator is increased largely, and a front end of the insulator was set so as to be disposed in the same position in the direction of the axis as the position of a front end of an insulator of the samples 1 and 2. The samples 3 to 6 were configured so that the front end portion of the inner layer was placed further forwards along the axis than the boundary of the shoulder portion and the main body portion.

Further, a thermal resistance evaluation test specified under JIS D1606 (a pre-ignition test) was carried out on the samples 1 to 3 and 5, as well as samples 7 and 8 which correspond comparison examples. The summary of the thermal resistance evaluation test carried out is as follows. Namely, the samples were mounted in a four-cylinder DOHC engine having a displacement of 1.6 L, and the engine was operated at full throttle (=5500 rpm) while advancing gradually the ignition timing from the normal ignition timing. Then, an ignition timing (a pre-ignition occurring advance angle) at which a pre-ignition occurred was identified based on the waveform of an ionizing current which was applied to the samples. It should be noted that the pre-ignition is made more difficult to occur, that is, the thermal resistance becomes more superior as the pre-ignition occurring advance angle becomes larger.

Figure 6A:
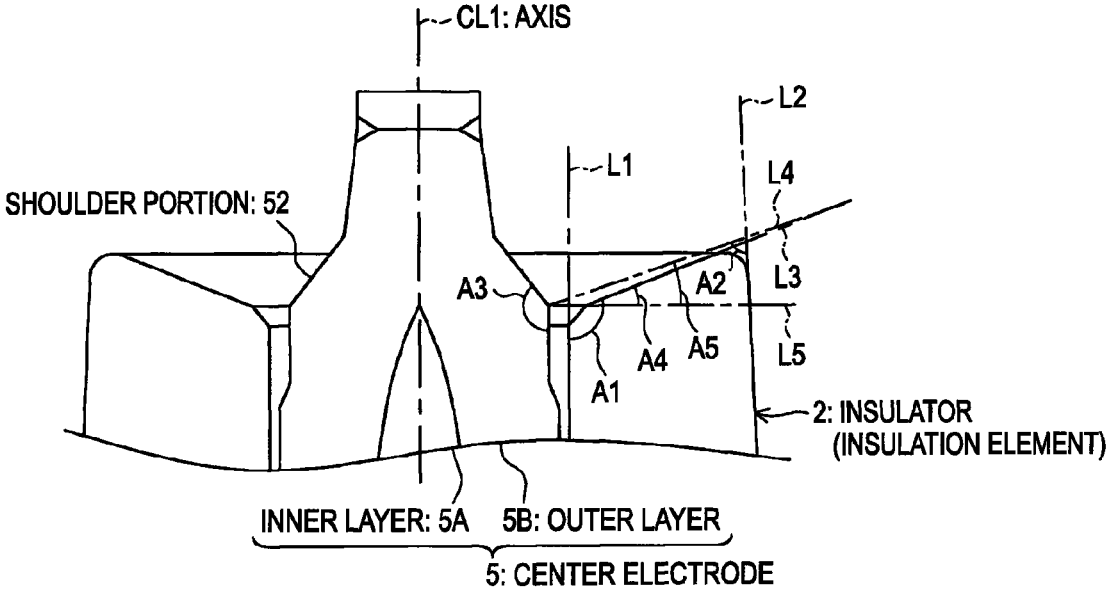
FIG. 6(*a*) is a partially enlarged sectional exemplary view showing a schematic configuration of a sample 7 and FIG. 6(*b*) is a partially enlarged sectional exemplary view showing a schematic configuration of a sample 8.
Figure 6B:
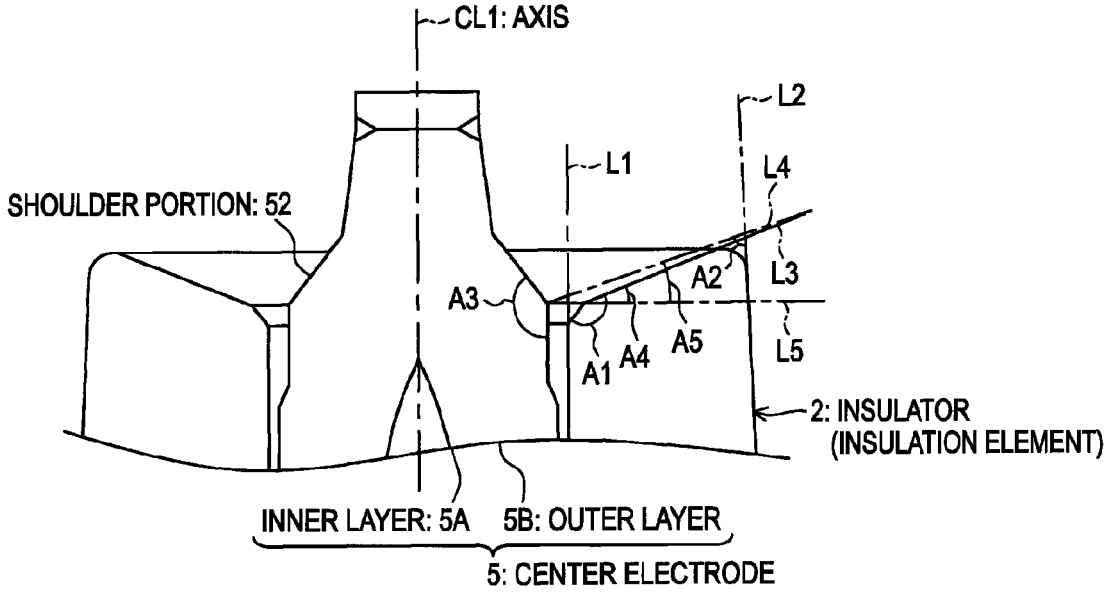

In addition, the samples 7, 8 were configured as follows. Namely, as to the sample 7, as shown in FIG. 6(*a*), values of the angles A1 to A5 were the same as those of the sample 1, while the front end of the inner layer of the center electrode was set so as to be disposed in the same position along the direction of the axis as that of the boundary between the shoulder portion and the main body portion. Additionally, as to the sample 8, as shown in FIG. 6(*b*), as with the sample 7, values of the angles A1 to A5 were the same as those of the sample 1, while the front end of the inner layer was set so as to be disposed 1.0 mm rearwards along the axis from the boundary between the shoulder portion and the main body portion.

Figure 7:
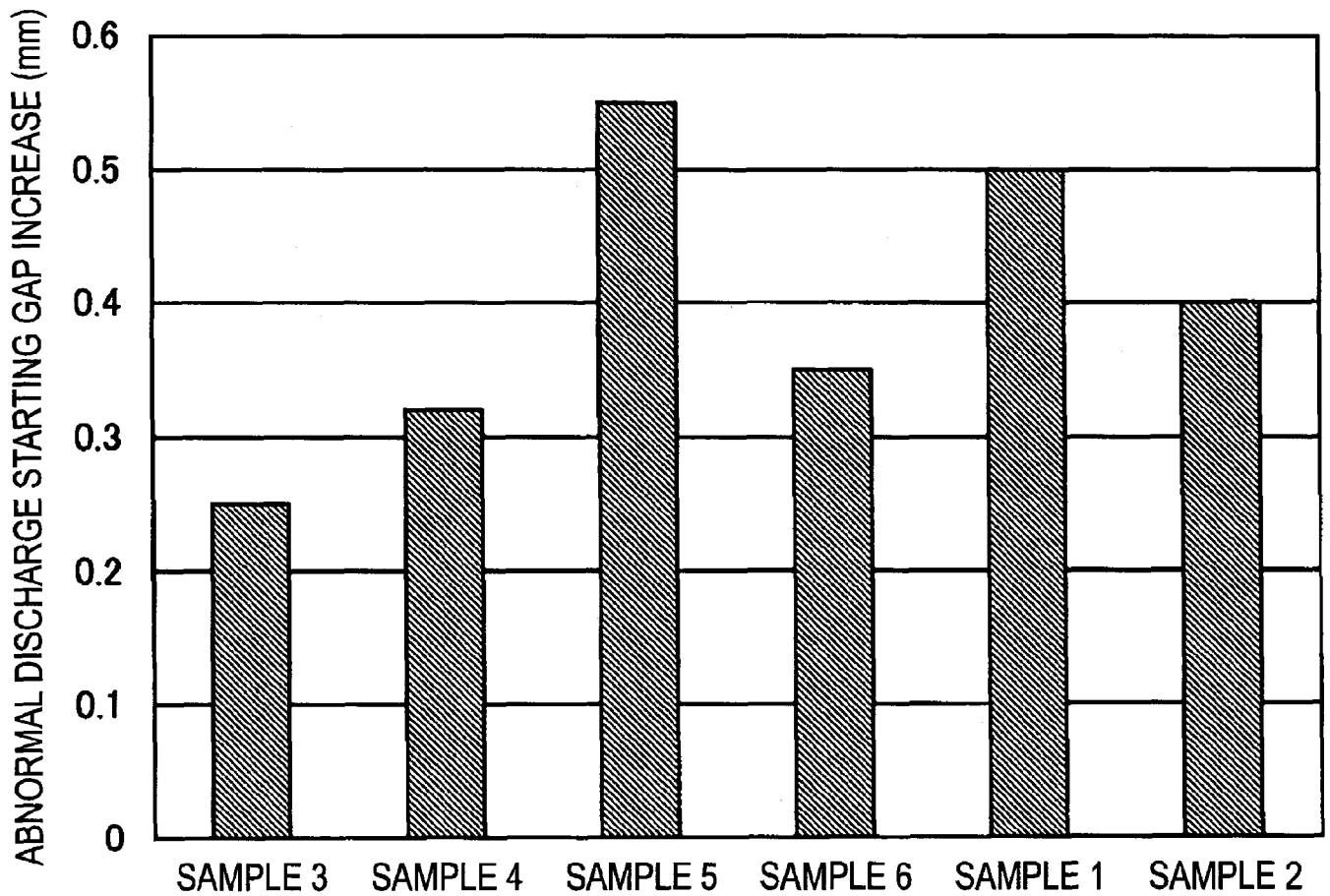
FIG. 7 is a graph showing the result of a flashover resistance evaluation test.
Figure 8:
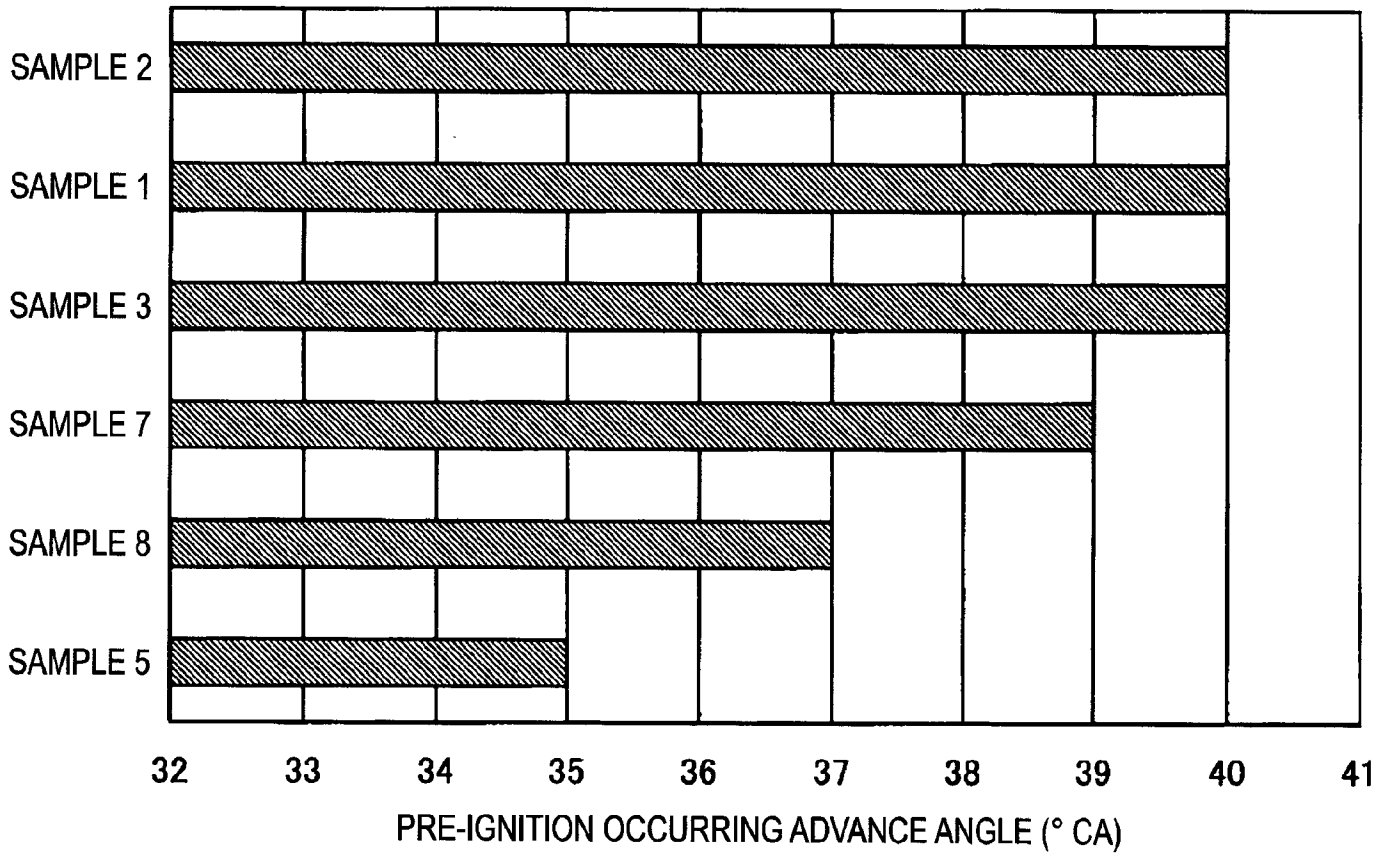
FIG. 8 is a graph showing the result of a thermal resistance evaluation test.

FIG. 7 shows the result of the flashover resistance evaluation test and FIG. 8 shows the result of the thermal resistance evaluation test.

As shown in FIGS. 7 and 8, with the sample 3 which did not satisfy A1>90° and A2<90°, it has become obvious that although the thermal resistance is superior, the abnormal discharge starting gap increase becomes very small and an abnormal discharge tends to be generated very easily. It is considered that this is because the sufficient creeping distance of the insulator could not be ensured because the front end face of the insulator extended in the direction which was at right angles to the axis.

Additionally, also with the sample 4 which did not satisfy A4>A5, it has been found that the abnormal discharge starting gap increase becomes small and the abnormal discharge tends to be generated easily. When a spark discharge is generated at the boundary portion between the shoulder portion and the main body portion, the discharge tends to be generated easily towards the direction of the straight line 4 along which the field strength becomes the largest. However, the front end face of the insulator was configured so as to slope more moderately than the direction along which a spark discharge is generated most easily at the boundary portion. Thus, it is considered that because of that front end face configuration, the discharge at the boundary portion is allowed to easily spark to the shell without being disturbed by the front end face of the insulator.

Further, with the sample 5 which did not satisfy A3>A1, it has become obvious that although the sufficient creeping distance of the insulator can be ensured to thereby provide the superior flashover resistance, the thermal resistance becomes insufficient. It is considered that this is because the front end portion of the insulator was overheated as a result of the volume of the front end portion of the insulator being reduced and the outer portion of the front end of the insulator projecting excessively towards the front end side in the direction of the axis.

In this test, the sample 5 was prepared so as not to satisfy A3>A1 by changing the angle A1 with the angle A3 left constant. However, when the sample is prepared so as not to satisfy A3>A1 by reducing the angle A3, it has been verified that the following problem is caused. Namely, the angle formed by the shoulder portion and the main body portion becomes small, and therefore, a discharge tends to be generated easily at the boundary portion therebetween when a voltage is applied, as a result of which an abnormal discharge tends to be generated easily. Namely, it can be said that when A3>A1 is not satisfied, the sufficient performance cannot be ensured with respect to at least either of thermal resistance and flashover resistance.

In addition, with the sample 6 in which the angles A1 to A5 were the same as those of the sample 5, while the radius of curvature of the curved surface portion was increased so as to reduce the volume of the front end portion of the insulator, it has been found that an abnormal discharge tends to be generated easily and the flashover resistance is slightly inferior. It is considered that this is because the creeping distance became relatively short and the increase in radius of curvature of the curved surface portion made it easy for the discharge to creep over the surface of the insulator.

Additionally, with the samples 7, 8 in which the front end of the inner layer was placed in the same position as or rearwards of the boundary between the shoulder portion and the main body portion along the axis, it has been verified that the thermal resistance was inferior. It is considered that this is because heat at the front end portion of the insulator could not be conducted to the shell sufficiently since the distance between the front end portion of the insulator and the inner layer having the superior thermal conductivity was relatively long.

In contrast with the samples 3 to 8 which have been described as comparison examples, it has become obvious with the samples 1, 2 which correspond to the embodiment that they have superior performances with respect to both flashover resistance and thermal resistance. It is considered that this is because the following factors (1) to (4) acted in a synergetic fashion. Namely, (1) the sufficient creeping distance could be ensured by satisfying A1>90° and A2<90° and causing the front end face of the insulator to slope towards the rear end side in the direction of the axis from the outer portion of the front end portion of the insulator towards the axial hole. (2) The discharge at the boundary portion is disturbed by the front end face of the insulator so as to prevent the occurrence of abnormal discharge between the boundary portion and the shell reliably by satisfying A4>A5 and causing the angle of the front end face of the insulator to be larger than the angle of the direction in which a spark discharge tends to be generated to spark most easily at the boundary portion. (3) The reduction in volume of the front end portion of the insulator which resulted from sloping the front end face of the insulator and the occurrence of discharge at the boundary portion could be suppressed by satisfying A3>A1. (4) Heat at the front end portion of the insulator could be conducted with good efficiency even in the insulator in which the outer portion of the front end side thereof was formed so as to project slightly forwards in the direction of the axis as has been described above by causing the front end position of the inner layer to be disposed to lie further forwards along the axis than the boundary between the shoulder portion and the main body portion. Thus, it is considered that the superior flashover resistance and thermal resistance were provided as a result of the synergetic action of these factors.

Additionally, in particular, with the sample 1 in which the shortest distance between the boundary points X1, X2 was 0.2 mm or longer, it has become obvious that the abnormal discharge is made more difficult to occur and the extremely superior flashover resistance is provided. It is considered that this is because the voltage required to generate a dielectric breakdown between the boundary portion and the insulator could be increased. Consequently, it is said that the shortest distance between the boundary points X1, X2 is preferably 0.2 mm or longer from the viewpoint that the abnormal discharge is prevented reliably and the flashover resistance is increased further.

Next, a ignitability evaluation test was carried out on samples A, B, C and D. The summary of the ignitability evaluation test carried out is as follows. Namely, the samples were mounted in a four-cylinder engine having a displacement of 1.5 L, and the engine was operated at idle (=1200 rpm). Then, a degree of variability in engine torque was measured for each air-fuel ratio while changing the air-fuel ratio. It should be noted that a smaller degree of variability in engine torque means better ignitability.

Figure 9A:
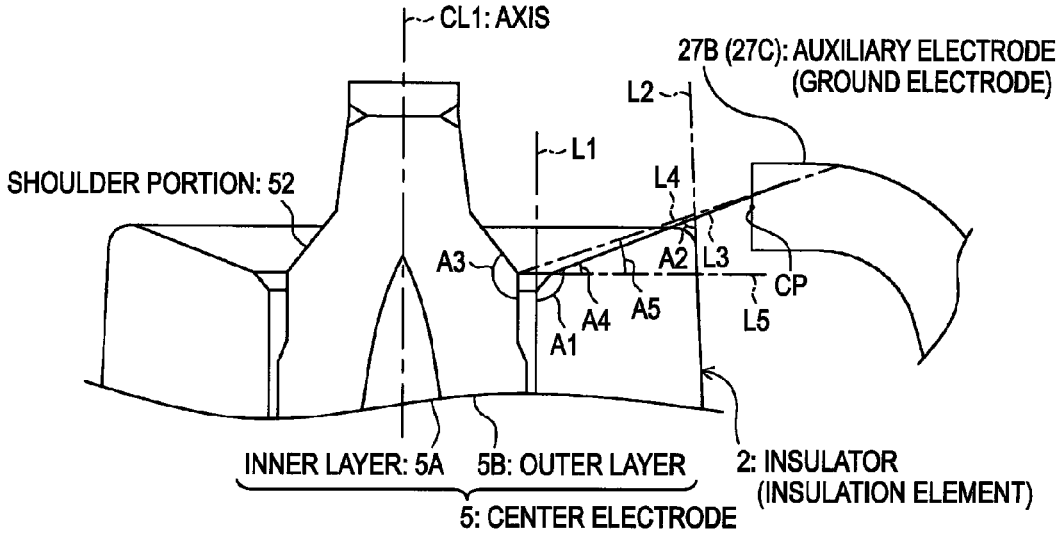
FIG. 9(*a*) is a partially enlarged sectional exemplary view showing a schematic configuration of a sample A and FIG. 9(*b*) is a partially enlarged sectional exemplary view showing a schematic configuration of a sample B.
Figure 9B:
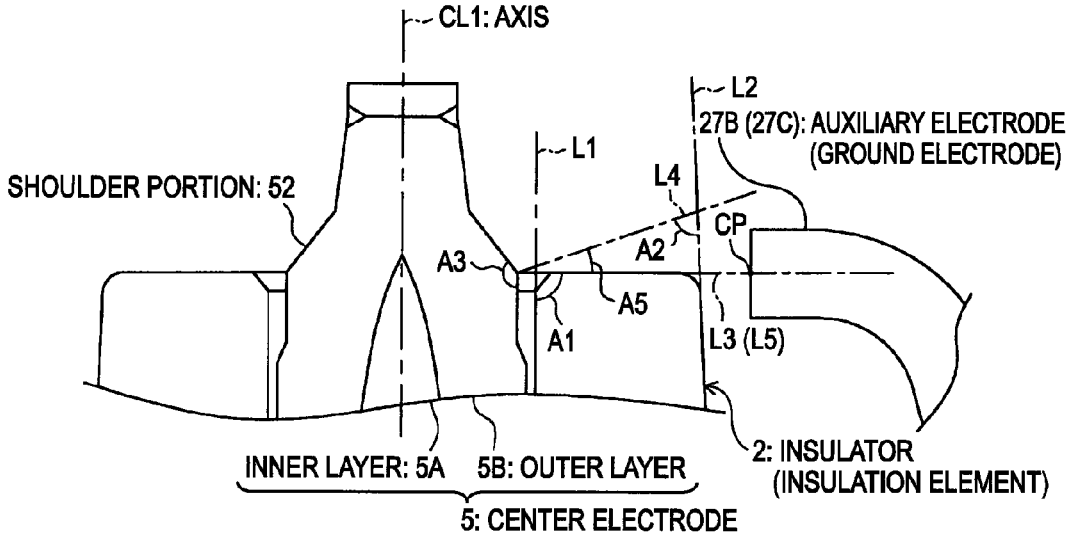

In addition, the samples A, B, C and D were prepared as follows. Namely, as to the sample A, as shown in FIG. 9(*a*), the insulator and the center electrode were configured in the same way as those of the sample 1 described above. Then, the auxiliary electrode was disposed so that in the cross-section which contains the axis and the center of the distal end face of the auxiliary electrode, the straight line L3 intersected part of the outline of the distal end face of the auxiliary electrode which was placed further forwards in the direction of the axis than the center of the distal end face.

Figure 10A:
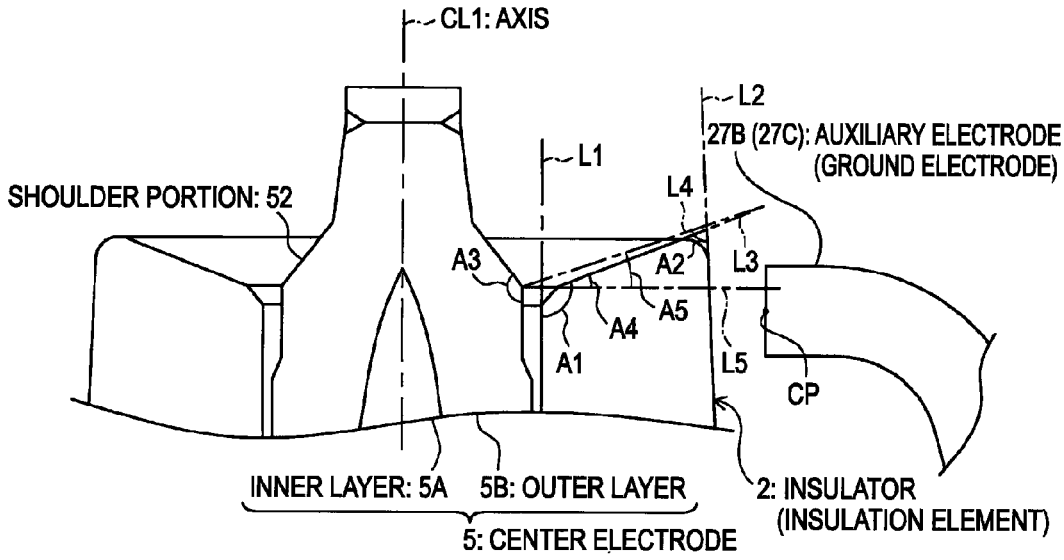
FIG. 10(*a*) is a partially enlarged sectional exemplary view showing a schematic configuration of a sample C and FIG. 10(*b*) is a partially enlarged sectional exemplary view showing a schematic configuration of a sample D.
Figure 10B:
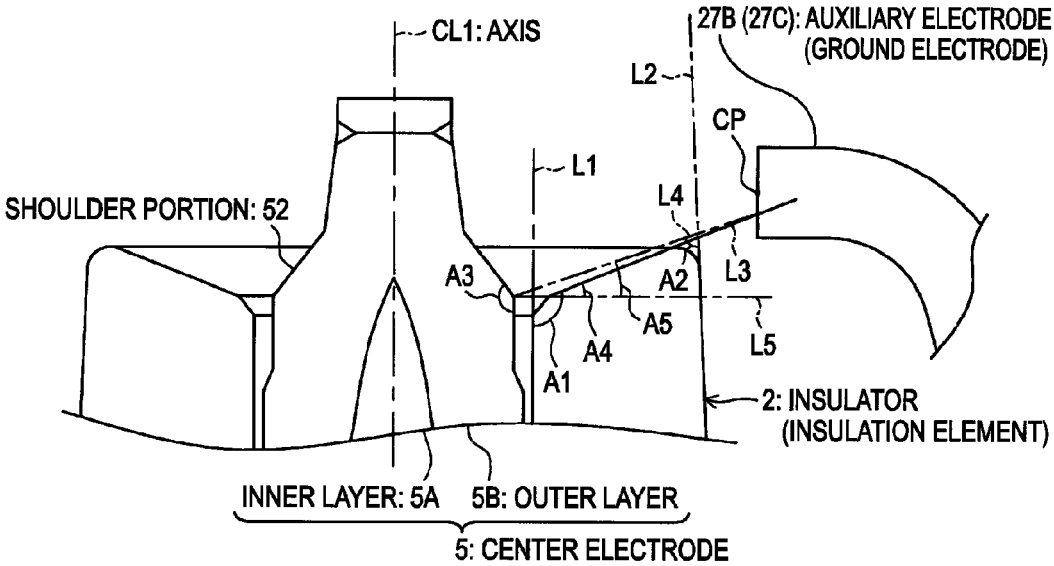

On the other hand, as to the sample B, as shown in FIG. 9(*b*), the insulator and the center electrode were configured in the same way as those of the sample 3 described above. Then, the auxiliary electrode was disposed so that the center of the distal end face of the auxiliary electrode was placed on the extension of the front end face of the insulator. Additionally, as to the sample C, as shown in FIG. 10(*a*), the insulator and the like were configured in the same way as those of the sample 1 described above. Then, by shifting the distal end position of the auxiliary electrode towards the rear end side in the direction of the axis, the straight line 3 and the distal end face of the auxiliary electrode were made not to intersect each other. Further, as to the sample D, as shown in FIG. 10(*b*), the insulator and the like were configured in the same way as those of the sample 1 described above. Then, by shifting the distal end position of the auxiliary electrode towards the front end side in the direction of the axis, the straight line 3 was made to intersect a part of the outline of the distal end face of the auxiliary electrode which was placed further rearwards in the direction of the axis than the center of the distal end face of the auxiliary electrode in the cross-section which includes the axis and the center of the distal end face of the auxiliary electrode.

In the ignitability evaluation test, in order to accurately grasp the effect of the distal end position on ignitability, the evaluation test was carried out on the samples A, B, C and D without providing a parallel electrode thereon so that a spark was only generated from the center electrode to the auxiliary electrode.

Figure 11:
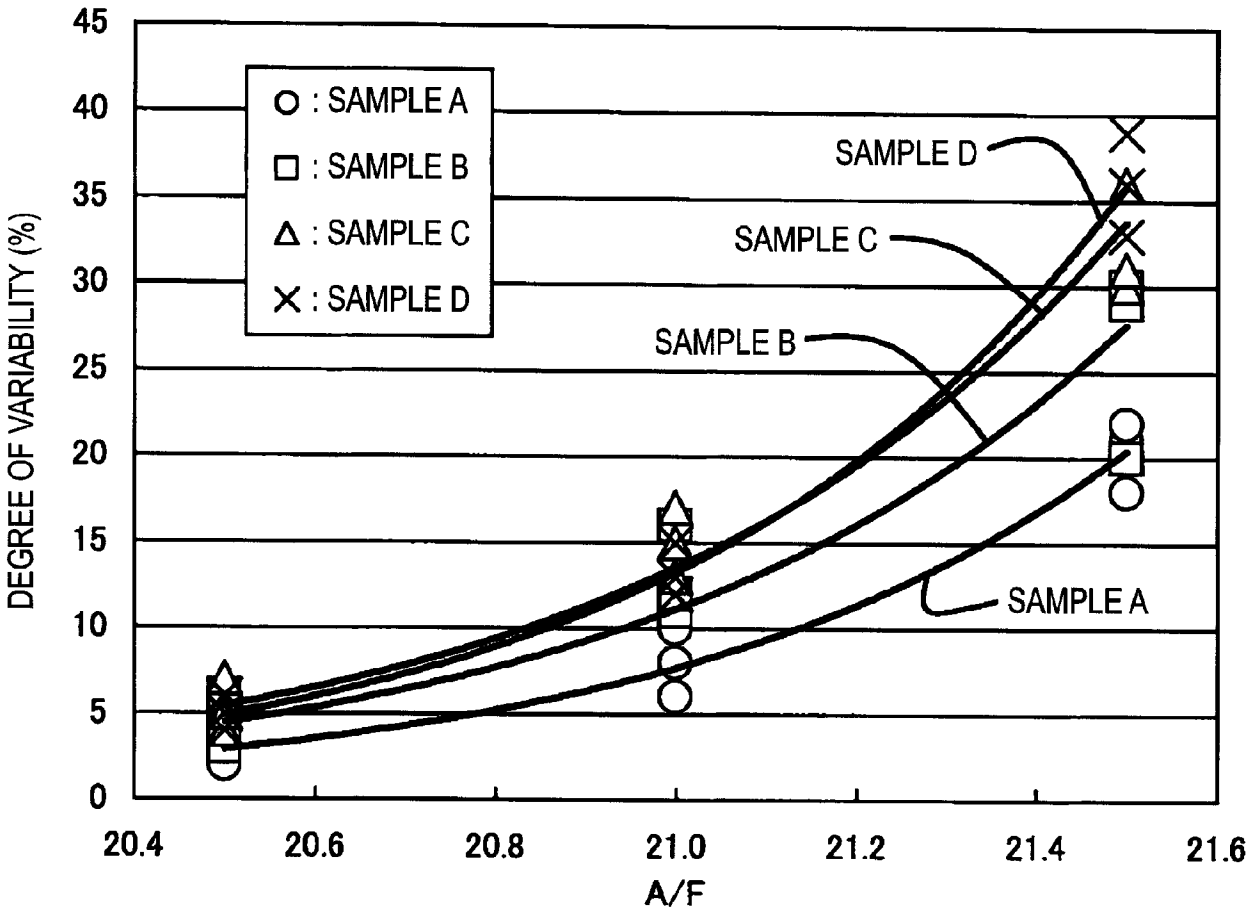
FIG. 11 is a graph showing the result of a thermal resistance evaluation test.

FIG. 11 shows the result of the ignitability evaluation test carried out.

As shown in FIG. 11, with the samples 13, C and D, it has become obvious that the degree of variability in engine torque became large as the air-fuel ratio became large (the air-fuel mixture became lean), whereby the ignitability became insufficient. It is considered that this is because when a spark discharge was generated between the boundary portion between the shoulder portion and the main body portion of the center electrode and the auxiliary electrode, the discharge was generated in the position which was spaced away from the center of the combustion chamber or the growth of flame was disturbed by the auxiliary electrode.

In contrast with this, with the sample A, it has become obvious that even under the conditions in which the air-fuel ratio was increased to make the combustion state unstable, the degree of variability in engine torque was relatively small and the superior ignitability were provided. It is considered that this is because the spark discharge was generated easily between the boundary portion between the shoulder portion and the main body portion of the center electrode and the corner portion of the corner portions of the distal end of the auxiliary electrode which was placed further forwards in the direction of the axis, that is, the spark discharge was generated easily in the position which was placed closer to the center of the combustion chamber and the growth of flame was made difficult to be disturbed by the auxiliary electrode.

Thus, in consideration of the result of the ignitability evaluation test, it can be said that in order to improve the ignitability, the straight line L3 is preferably made to intersect part of the outline of the distal end face of the ground electrode which is placed further forwards in the direction of the axis than the center of the distal end face of the ground electrode in the cross-section which includes the axis and the center of the distal end face of the auxiliary electrode (the ground electrode).

The invention may be carried out as follows, for example, without being limited to what has been described heretofore with respect to the embodiment. Of course, other application examples or modified examples than those which will be described below can also be adopted.

Figure 12:
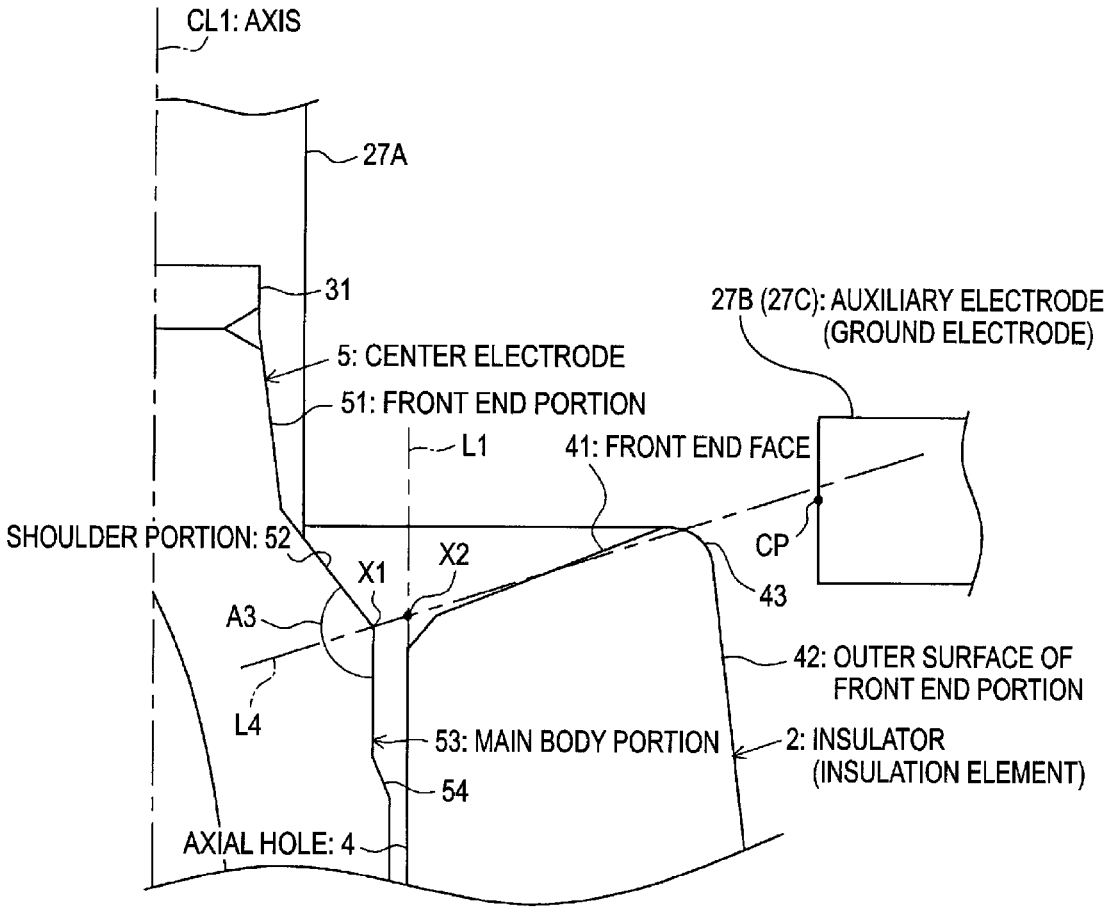
FIG. 12 is a partially enlarged sectional exemplary view showing the configurations of a front end portion of an insulator and the like according to a different embodiment.

(a) Although not described particularly in the embodiment, as shown in FIG. 12, the center electrode 5 and the insulator 2 may be configured so that the straight line L4 intersects the outline of the front end face 41 of the insulator 2 in the cross-section which includes the axis CL1. In this case, the spark to the shell 3 can be prevented by the front end face 41 of the insulator 2 more reliably, thereby making it possible to prevent a direct discharge between the boundary portion between the shoulder portion 52 and the main body portion 53 and the shell 3 more effectively. As a result, a more superior flashover resistance can be realized.

Figure 13:
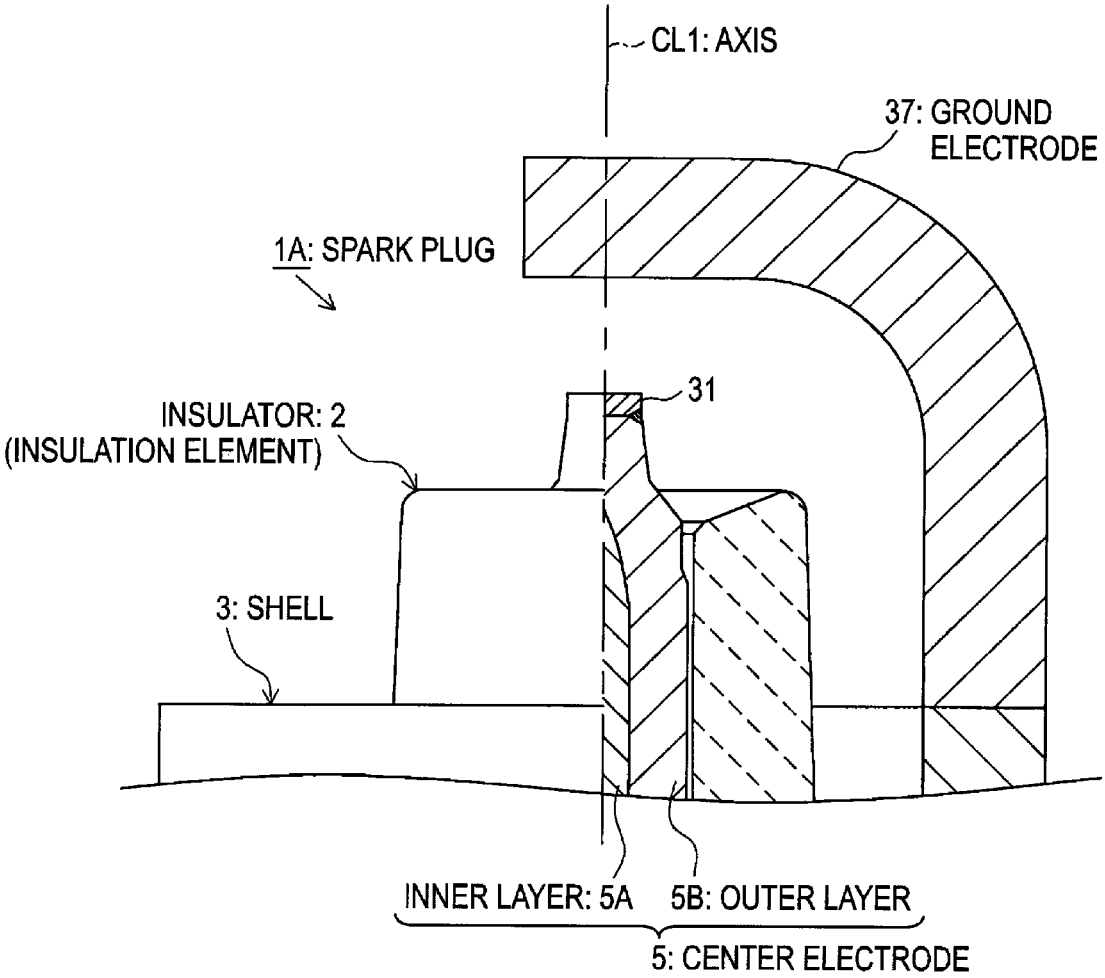
FIG. 13 is a partially cutaway enlarged front view showing the configuration of a front end portion of a spark plug of another different embodiment.
Figure 14:
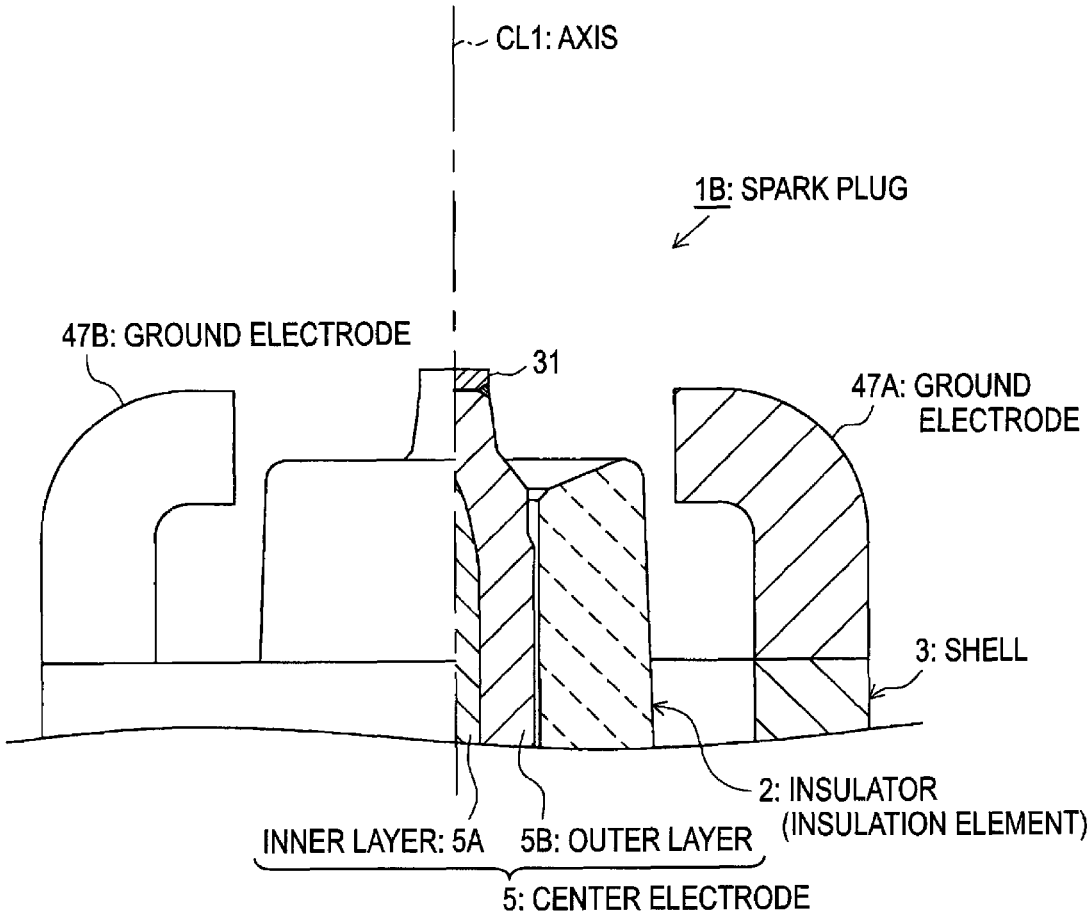
FIG. 14 is a partially cutaway enlarged front view showing the configuration of a front end portion of a spark plug of a further different embodiment.

(b) Although the spark plug 1 of the embodiment is of the hybrid type in which the parallel electrode 27A and the auxiliary electrodes 27B, 27C are provided, the configuration of the spark plug to which the technical concept of the invention can be applied is not limited thereto. For example, as shown in FIG. 13, the technical concept of the invention may be applied to a spark plug 1A of a so-called parallel electrode type which includes a ground electrode 37 of which a side surface of a front end portion faces a front end face of a center electrode 5 (a noble metal tip 31). Additionally, as shown in FIG. 14, the technical concept of the invention may be applied to a spark plug 113 of a so-called semi-surface discharge type which includes a pair of ground electrodes 47A, 47B of which distal end faces face a side surface of a center electrode 5 (a noble metal tip 31). It should be noted that the number of ground electrodes provided on the semi-surface discharge type spark plug 1B is not limited to two, and hence, one or three or more ground electrodes may be provided.

(c) Although the shortest distance between the boundary points X1, X2 is described as being 0.2 mm or longer in the embodiment, the shortest distance between the boundary points X1, X2 may be shorter than 0.2 mm.

(d) Although the tapered portion 54 is formed on the center electrode 5 in the embodiment, the center electrode 5 may be formed without the tapered portion 54 being formed thereon.

(e) Although the center electrode 5 has the double-layer construction configured by the inner layer 5A and the outer layer 5B in the embodiment, the center electrode 5 may have a three-layer construction or a multi-layer construction made up of four or more layers. Consequently, for example, an intermediate layer made of a copper alloy or pure copper may be provided on an inner side of the outer layer 5B, and an innermost layer made of pure nickel may be provided on an inner side of the intermediate layer. When the center electrode 5 has a construction made up of three or more layers, plural layers correspond to the inner layer 5A which are placed on an inner side of the outer layer 5B and which contain a metal having a better thermal conductivity than that of the outer layer 5B. For example, in the case of the configuration being adopted in which the intermediate layer and the innermost layer are provided, the intermediate layer and the innermost layer correspond to the inner layer 5A.

(f) Although the noble metal tip 31 is joined to the front end portion of the center electrode 5 in the embodiment, the noble metal tip 31 may not be provided.

(g) Although the thread diameter of the thread portion 15 is described as being M12 or smaller in the embodiment, the thread diameter of the thread portion 15 is not limited thereto. Consequently, the thread diameter of the thread portion 15 may be M12 or larger.

(h) Although the ground electrode 27 is described as being joined to the front end face of the distal end portion 26 of the shell 3 in the embodiment, the invention may also be applied to an embodiment in which a ground electrode is formed by carving part of the shell (or part of a metal tip which is welded to the shell in advance) (for example, JP-A-2006-236906). In addition, the ground electrode 27 may be joined to a side surface of the front end portion 26 of the shell 3.

(i) Although the tool engagement portion 19 has the hexagonal cross-section in the embodiment, the shape of the tool engagement portion 19 is not limited to such a shape. For example, a Bi-HEX (a modified dodecagonal) shape [ISO22977:2005(e)] or the like may be adopted.

DESCRIPTION OF REFERENCE NUMERALS AND SIGNS

1, 1A, 1B Spark plug; 2 Insulator (Insulation element); 3 Shell; 4 Axial hole; 5 Center electrode; 5A Inner layer; 5B Outer layer; 27A Parallel electrode; 27B, 27C Auxiliary electrode (Ground electrode); 41 Front end face (of Insulator); 42 Outer surface of front end portion (of Insulator); 51 Front end portion (of Center electrode); 52 Shoulder portion; 53 Main body portion; CL1 Axis.

The invention claimed is:

1. A spark plug comprising:

an insulator having an axial hole which extends along an axis;

a center electrode which is inserted into a front end portion of the axial hole and which has a front end placed further forwards than a front end of the insulator; and a cylindrical shell which is provided around an outer circumference of the insulator;

the center electrode including a shoulder portion which increases in diameter as it extends from a rear end of a front end portion of the center electrode towards a rear end side and a main body portion which extends from a rear end of the shoulder portion towards the rear end side along the axis, the center electrode having a multi-layer construction configured of an outer layer and an inner layer which is provided in an interior of the outer layer and which contains a material having higher thermal conductivity than that of the outer layer, characterized in that:

a front end face, which is connected to an outer circumferential surface of the insulator and the axial hole and slopes towards the rear end side, is formed at a front end portion of the insulator, the front end of the insulator is placed further forwards than a boundary between the shoulder portion and the main body portion of the center electrode, a front end portion of the inner layer is placed further forwards along the axis than the boundary between the shoulder portion and the main body portion of the center electrode, and regarding a cross-section which includes the axis, when a straight line which is obtained by extending an outline of the axial hole towards the front end side is referred to as a straight line L1, a straight line which is obtained by extending an outline of an outer surface of the front end portion of the insulator towards the front end side is referred to as a straight line L2, a straight line which is obtained by extending an outline of the front end face of the insulator is referred to as a straight line L3, a bisector of an angle formed by an outline of the shoulder portion and an outline of the main body portion is referred to as a straight line L4, and a straight line which intersects the axis at right angles is referred to as a straight line L5, angles A1, A2, A3, A4 and A5 which are described below satisfy the following expressions (1), (2), (3) and (4):

$$A1>90° \quad (1);$$

$$A2<90° \quad (2);$$

$$A4>A5 \quad (3);$$

$$A3>A1 \quad (4),$$

where, the angle A1: an angle placed on a side where the insulator exists in angles which are formed by the straight line L1 and the straight line L3;

the angle A2: an angle placed on a side where the insulator exists in angles which are formed by the straight line L2 and the straight line L3;

the angle A3: an angle which is formed by the outline of the shoulder portion and the outline of the main body portion;

the angle A4: an acute angle in angles which are formed by the straight line L3 and the straight line L5;

the angle A5: an acute angle in angles which are formed by the straight line L4 and the straight line L5.

2. A spark plug according to claim 1, characterized in that, regarding the cross-section which includes the axis, when a boundary point between the shoulder portion and the main body portion is referred to as X1 and a point of intersection between the straight line L1 and the straight line L3 is referred to as X2, a shortest distance between the boundary point X1 and the boundary point X2 is 0.2 mm or longer.

3. A spark plug according to claim 1, comprising a ground electrode of which a distal end face faces a side surface of the center electrode, characterized in that, regarding a cross-section which includes the axis and a center of the distal end face of the ground electrode, the straight line L3 intersects a portion of an outline of the distal end face of the ground electrode which is placed further forwards in the direction of the axis than the center of the distal end face.

4. A spark plug according to claim 1, characterized in that, regarding the cross-section which includes the axis, the straight line L4 intersects the outline of the front end face of the insulator.

* * * * *